United States Patent [19]

Müller et al.

[11] Patent Number: 4,711,189

[45] Date of Patent: Dec. 8, 1987

[54] SEWING ARRANGEMENT WITH FEED DEVICE

[75] Inventors: Richard Müller, Mehlbach; Roland Leis; Axel Zinssmeister, both of Rothselberg, all of Fed. Rep. of Germany

[73] Assignee: Pfaff Industriemaschinen GmbH, Fed. Rep. of Germany

[21] Appl. No.: 20,593

[22] Filed: Mar. 2, 1987

[30] Foreign Application Priority Data

Mar. 5, 1986 [DE] Fed. Rep. of Germany ..... 3607107

[51] Int. Cl.[4] ..... D05B 21/00; D05B 27/00

[52] U.S. Cl. ..... 112/121.12; 112/104; 112/308

[58] Field of Search ..... 112/121.12, 121.11, 112/121.15, 73, 104, 102, 113, 308

[56] References Cited

U.S. PATENT DOCUMENTS

| | | | |
|---|---|---|---|
| 3,983,825 | 10/1976 | Dobner et al. | 112/121.12 |
| 4,419,946 | 12/1983 | Fischer et al. | 112/121.12 |
| 4,446,802 | 5/1984 | Scholl | 112/121.12 |
| 4,462,320 | 7/1984 | Scholl | 112/121.12 X |
| 4,541,348 | 9/1985 | Fischer | 112/121.12 |
| 4,555,998 | 12/1985 | Martin | 112/104 X |

*Primary Examiner*—H. Hampton Hunter

*Attorney, Agent, or Firm*—McGlew and Tuttle

[57] ABSTRACT

A sewing arrangement is provided with a feed device which comprises a drive device, a pitman drive, and a work holder received by a support. The feed device, designed so as to be subject to little wear, permits the execution of purely translatory movements with great accuracy, in that the pitman drive has associated with it a parallel guiding means which together with the pitman drive is articulated to the support of the work holder.

8 Claims, 3 Drawing Figures

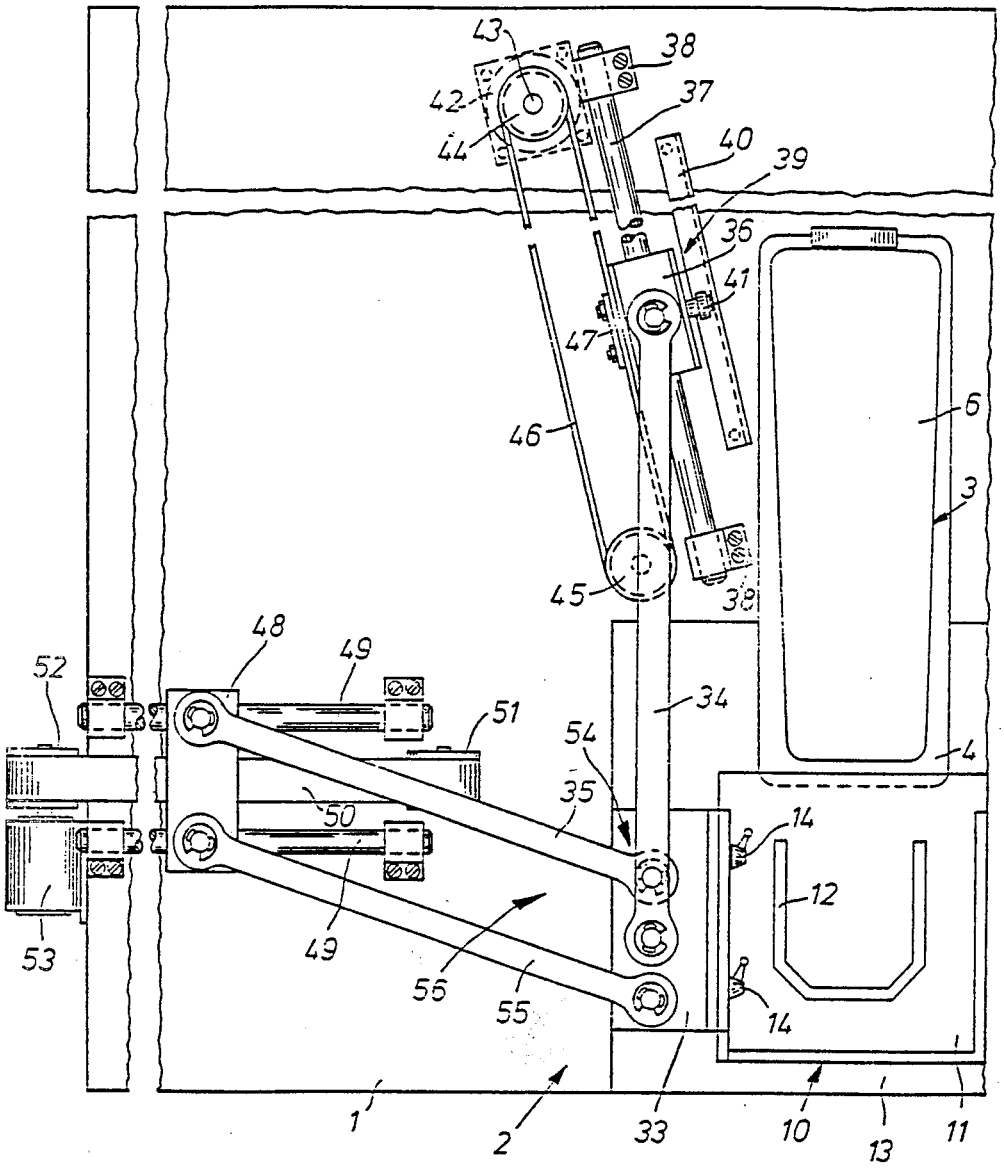
43
38
42
37
44
40
39
36
41
47
6
46
3
45
38
48
49
52
51
34
54
4
35
50
14
12
53
49
56
55
14
1
2
33
10
13
11

SEWING ARRANGEMENT WITH FEED DEVICE

FIELD AND BACKGROUND OF THE INVENTION

The present invention relates in general to sewing machines and in particular to a new and useful sewing arrangement and device for moving a workpiece to accurately move it through positions for sewing seams thereon.

A similar feed device is known for example from U.S. Pat. No. 4,419,946, dated Dec. 13, 1983 and comprises two links, each provided with a drive, which are articulated to two pitmans and forms with them a parallelogram. At a section of one of the pitmans extending beyond the parallelogram, a work holder pivots about a hinge pin. The hinge pin is connected via toothed or gear belts with an additional drive, in order that the work holder can be pivoted about the hinge pin. The toothed belts, which are disposed in the interior of a link with rectangular hollow section and in a pitman of the same design, are passed over gears and over a pinion connected with the additional drive. During sewing, the parallelogram is pivoted about a fixed bearing, at which the two links engage. Thereby the gears supported in one of the links or one of the pitmans are oscillated about the pinion, which is fastened on a shaft of the additional drive disposed in the fixed bearing. With this drive standing still, the gears are rotated relative to the stopped pinion in the course of the pivoting movement of the parallelogram just far enough for the work holder to be displaced parallel to itself, i.e. in a purely translatory movement.

Because toothed belts are used for the guiding of the work holder, faults may occur due to elongation of the belts, which at high sewing speed are under heavy stress. The amount of these elongations depends on the load as well as on the state of the belts. In case of frequently occurring, relatively strong elongations the belts are moreover subject to considerable wear, so that they may have to be changed often.

SUMMARY OF THE INVENTION

The invention provides a feed device for the execution of purely translatory movements, the device being constructed so as to have little wear and to permit precise transmissions of movements.

In accordance with the invention, a pitman drive known per se, engages at a support of a work holder and it is supplemented by at least one parallelly extending auxiliary pitman which serves only to guide the work holder. From the general science of gears and transmissions pitman drives with two parallel pitmans pivotable about fixed bearings for the nonrotational guiding of a connecting rod are indeed known as parallel link drives, but what is new is to provide such a connecting rod as support of a work holder of a feed device, the pitmans of which are connected with a drive. By reason of the principle, the position of the work holder always remains parallel to an imaginary bar between the two fixed bearings about which the pitmans pivot.

The at least one additional auxiliary pitman used for guiding the work holder causes only a slightly greater inertia of the feed device if it is designed and manufactured according to modern criteria of light-weight construction. Thus also high operating speeds are realizable with the feed device according to the invention.

As the parallel link drive is constructed from solid, positively guided drive elements, the feed device is largely vibration-free and subject to little wear, owing to which hign guide precision is achieved over the long term.

Accordingly, it is an object of the invention to provide a device for moving a workpiece to accurately move it through positions for sewing seams thereon which includes a sewing machine having a support with a work holder movable with the workpiece over the support for moving the workpiece into association with the sewing machine sewing needle and including a pitman drive having a pivotal pitman support connectable to the work holder, the pitman drive including a drive member and parallel guide means connected between the drive member and the pitman support.

A further object of the invention is to provide a sewing arrangement including the sewing machine and a workpiece feed device which includes a workpiece holder having a support of the drive connectable to the holder, the drive including parallel guide means which is hinged to the pitman support connected to the workpiece holder.

A further object of the invention is to provide a driving mechanism for positioning a workpiece on a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 3 is a top plan view of the sewing arrangement of the second embodiment.

DESCRIPTION OF THE PREFERRED EMBODIMENTS

Figure 1:
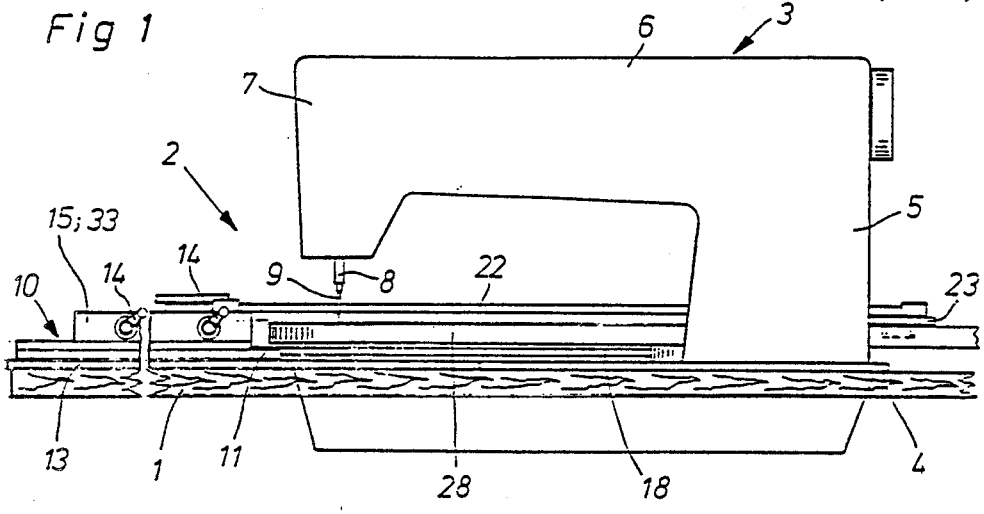
FIG. 1 is a front view of the sewing machine used in both embodiment examples.
Figure 2:
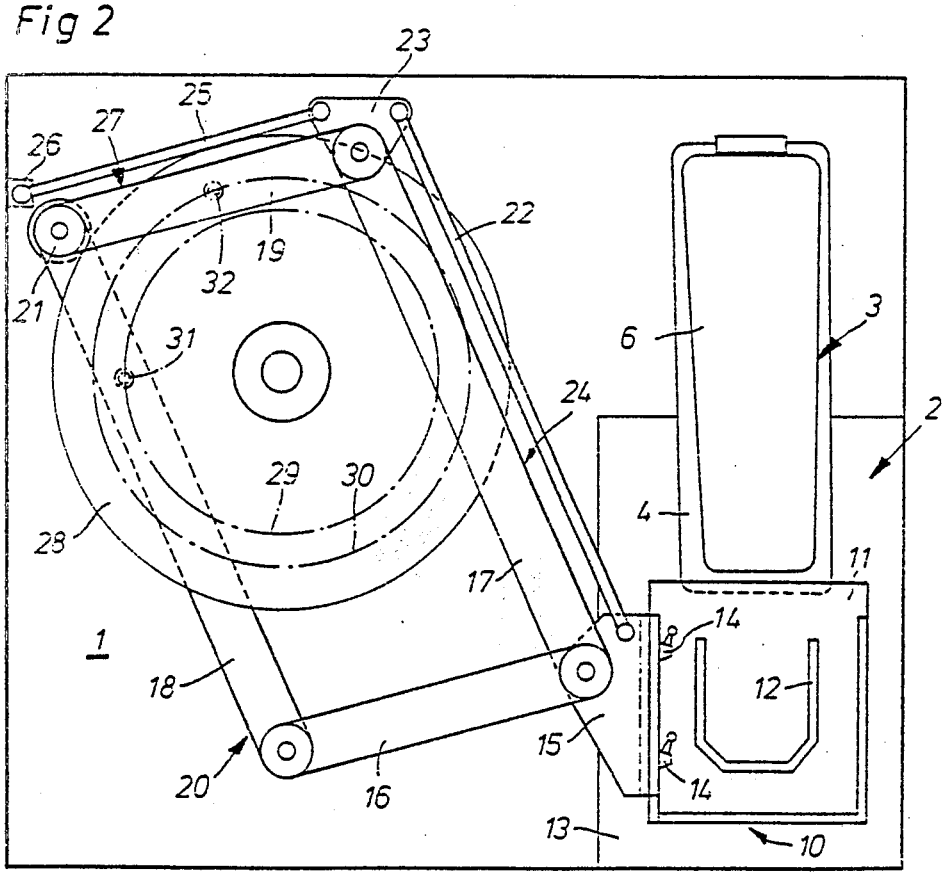
FIG. 2 is a top plan view of the sewing arrangement of a first embodiment of the invention.

Referring to the drawings in particular, the invention embodied therein comprises a device for moving a workpiece for accurately moving it through positions for sewing seams thereon by a sewing needle 9 of a sewing machine 3 shown in the sewing arrangement 2 shown in FIG. 1 and supplemented by either the pitman drive of FIG. 2 or that of FIG. 3.

In accordance with the invention, the drive include workpiece holder 10 which is movable over a garment support 13 which comprises the workpiece and holds the workpiece with the work holder so that it may be positioned in respect to the needle for sewing. The positioning drive includes a pitman drive generally designated 20 in FIG. 2 or the pitman drive generally designated 54 in FIG. 3. Pitman drives include a pivotable pitman support such as the support 15 shown in FIG. 2 connected to the work holder 10 in a drive member which in the embodiment of FIG. 2 comprises a rotatable drive disc or control disc 28 as well as parallel guide means which in the embodiment of FIG. 2 comprises a parallel link drive device 24 and in the embodiment of FIG. 3 comprises the parallel link drive 56. In the embodiment of FIG. 2, the parallel guide means include the members 17 and 22 connected between the drive member 28 and the pitman support 15.

EMBODIMENT EXAMPLE 1

Fastened on a Table 1 of a sewing arrangement 2 is a sewing machine 3 which comprises a base plate 4, a standard 5, and an arm 6. Arm 6 terminates in a head 7, in which is mounted a needle bar 8 driven in a known manner, which carries a needle 9.

For holding work to be sewn, a work holder 10 is used which comprises a plate 11 which frictionally grips the work and which is provided with a cutout 12 corresponding to the form of the seam. Arranged on Table 1 is a support plate 13, the top side of which is flush with the top of the base plate 4 of the sewing machine 3. Plate 11 rests on this support plate 13.

The work holder 10 is detachably connected with a support 15 by toggle bolts 14. At the support 15 two pitmans 16,17 engage at a common joint.

Pitman 16 is hinged to a link 18, pitman 17 to a link 19, link 18 being arranged parallel to pitman 17 and link 19 parallel to pitman 16. The links 18,19, which together with the Pitmans 16,17 form a parallelogram 20 as pitman drive, are arranged to pivot about a fixed bearing 21.

At the support 15, in addition to the pitmans 16 and 17 there engages guide means or an auxiliary pitman 22 which is parallel to pitman 17 and whose opposite end is articulated to a connecting rod 23. Connecting rod 23 is pivotably held at the articulated junction between pitman 17 and link 19.

Together with the connecting rod 23 and support 15, pitman 17 and auxiliary pitman 22 form a parallel link drive 24. Also, connecting rod 23 is articulated to an auxiliary pitman 25 which, at its opposite end, pivotably engages at a fixed bearing 26. The imaginary bar between the two fixed bearings 21, 26 on Table 1 forms, together with link 19, auxiliary pitman 25 and connecting rod 23, a parallel link drive 27.

The links 18 and 19 are drivable by a rotatable control disc 28 which is connected with a motor (not shown) and in which guide grooves 29, 30 are cut. The links 18, 19 have pins on which guide rollers 31, 32 are seated. These guide rollers 31, 32 protrude into the guide grooves 29, 30, shown in FIG. 2 simply as dash-dot circles. As a whole, the feed device according to FIG. 2 is formed by the control disk 28, the parallelogram pitman drive 20, the two auxiliary pitmans 22 and 25 as well as the connecting rod 23 and the support 15 of the work holder 10.

The feed device operates as follows: The sewing arrangement 2 serves for example to sew pockets on garments. The work holder 10, detached from the support 15, are placed on the respective garment and pocket in such a way that the cutout 12 is where later the seam is to be formed. Then the work holder 10, which frictionally retains the garment and the pocket, is moved over the support plate 13 and again connected with the support 15. Thereafter the work cycle of the sewing arrangement 2 can be started. For this purpose the control disc 28 is set in rotatation, whereupon it moves the work holder 10 out of the inactive position shown in FIG. 2 into the sewing position.

Upon rotation of the control disc 28, the links 18 and 19 are swivelled about the fixed bearing 21, so that they change their position relative to each other, as do also the pitmans 16,17 connected with the links 18,19. Because the pitman 17 and the link 19 are part of the parallel link drive 24,27, they too together with the support 15 of the work holder 10 are moved into a new position. Being guided by the two parallel link drives 24 and 27, the work holder 10 is shifted transversely only. After the work holder 10 has reached the sewing position, the sewing machine 3 is turned on with the control disc 28 continuing to run, and the desired seam is formed.

EMBODIMENT EXAMPLE 2

The feed device of this example is illustrated in FIG. 3 together with the sewing machine 3 known from the first example, arranged on the Table 1, and also with the work holder 10 displaceable on the plate 13. The work holder 10 serves to hold a workpiece and is moved under the stitch-forming needle 9 of the sewing machine 3 to produce a seam. The new feed device according to FIG. 3 comprises a support 35, on which the work holder 10 is to be attached in a manner known from the description of FIGS. 1 and 2.

Two pitmans 34, 35 pivotable separately of each other engage at the support 33 at different bearing points. At its end away from the support 33, pitman 34 is articulated to a slide 36. Slide 36 is displaceably mounted on a rod 37 secured on the Table 1 by bearing brackets 38. To lock the slide 36 against rotation about the axis of the slide rod 37 a safety device 39 in the form of a U-shaped rail 40 running parallel to rod 37 is provided; it is applied on the Table 1 and serves to receive rollers 41 provided at the slide 36, in that said rollers abut above and below one of the two legs of the sectional rail 40.

The slide 36 has its own drive. To this end a step motor 42 is fastened on the Table 1. A shaft 43 protruding from the housing of this step motor 42 serves to receive a toothed pulley 44 firmly connected with shaft 43. A toothed or gear belt 46 is passed over the pulley 44 as well as over a deflecting wheel mounted on the table. Slide 36 is connected with the toothed belt 46 via a toothed pressure plate 47 adapted to the surface of the toothed belt 46.

The second pitman 35, engaging at the support 33, is articulated at its opposite end to a slide 48. Like slide 36, slide 48 is displaceable on rods 49 and connected with a toothed belt 50. The toothed or gear belt 50 is passed over a deflecting wheel 51 as well as over a toothed pulley 52, which is driven by a step motor 53 attached on the Table 1.

Together with the pitmans 34 and 35 as well as the support 33 of the work holder 10, the two slides 36 and 48 form a pitman drive 54.

For more exact guiding of the support 33 and hence of the work holder 10 the aforesaid pitman drive 54 is provided with an additional auxiliary pitman 55 which is articulated to the support 33 and engages by its opposite end at the slide 48. The auxiliary pitman 55 may be dimensioned and designed just like the pitman 35 and is arranged parallel to the latter. In conjunction with the slide 48 and support 33, the pitman 35 and auxiliary pitman 55 form a parallel link drive 56. As the slide 48 for holding the pitman 35 and auxiliary pitman 55 is wider than the slide 36, it is disposed on two slide rods 49, so that no additional rotation lock of the slide 48, as in the case of slide 36, is needed.

The feed device illustrated in FIG. 3 operates as follows:

After the uptake of two fabric pieces to be sewn together, the work holder 10 is connected with the support 33 in the manner already described. Thereafter the work cycle of the sewing arrangement 2 is started. The work holder 10 is moved from the inactive position shown in FIG. 3 into the sewing position, in that the step motors 42,53 execute a corresponding number of drive steps program controlled with time overlap. Control of the step motors 42, 53 can be affected by a known microcomputer (not shown) which computes the required number of drive pulses for each of the two step motors 42,53 from position data contained in a memory. The step motors 42,53 drive the toothed belts 46,50, which in turn move the slides 36, 48 on the slide rods 37,49. The movement of the slides 36, 48 is transmitted to the pitmans 34, 35 or to the auxiliary pitman 55, the work holder 10 being thus moved in the manner established in the program until the point where the seam is to begin is under the needle of the sewing machine 3. Then the sewing machine is turned on and in cooperation with the program controlled step motors 42,53 the desired seam is formed, the angle position of the work holder 10 being always maintained.

While specific embodiments of the invention have been shown and described in detail to illustrate the application of the principles of the invention, it will be understood that the invention may be embodied otherwise without departing from such principles.

What is claimed is:

1. A sewing arrangement including a sewing machine, a workpiece feed device including a workpiece holder, a support connectable to said workpiece holder, a workpiece drive device, a pitman drive connected to said workpiece drive device into said support, said pitman drive including parallel guide means pivotally connected to said support.

2. A sewing arrangement according to claim 1, wherein said pitman drive comprises a parallelogram formed by two driven links and two pitmans, an auxiliary pitman for each of said pitmans, one of said pitmans and one of said links forming in conjunction with said auxiliary pitman for each a common connecting rod, two interconnected parallel link drives.

3. A sewing arrangement according to claim 1, wherein said pitman drive comprises two pitmans pivotally arranged on a movable slide, one of said pitmans has associated with it an auxiliary pitman which forms with said pitman the slide and said support of the workholder a parallel link drive.

4. A device for moving a workpiece to accurately to move it through positions for sewing seams thereon, comprising a sewing machine having a support, a work holder movable over said support with the work for moving the work in association with the sewing machine support and a pitman drive including a pivotal pitman support connected to said work holder, said pitman drive being connected to said pitman support and including a drive member, and parallel guiding means connected between said drive member and said pitman support.

5. A device according to claim 4, wherein said drive member comprises a rotatable control disc having at least one guide groove, said pitman drive including the pitman comprising parallelogram links, two of said links having follower members engaged in associated guide grooves of said control disc, said pitman driving including a first pitman link and connected to said pitman support, a second parallel guide link connected to said pitman support, a connecting rod pivotable about the end of said first pitman link member, said pitman drive including a second link member forming a part of a parllel linkage and including an auxiliary pitman link connected between said connectiong rod and a fixed bearing pivot.

6. A device according to claim 4, wherein said pitman drive member comprises a stepping motor, a slide movable backwardly and forwardly, guide means on which said slide is movable, at least one pitman link being pivotally connected to said pitman holder and to said slide, and means connected between said stepping motor and said slide for moving said slide in response to rotation of said motor.

7. A device according to claim 6, wherein said at least one link pivoted between said slide and said pitman holder includes two links arranged as a parallogram between said slide and said holder, said motor including a rotatable gear member having a gear belt connected thereto and driven thereby which is connected to said slide.

8. A device according to claim 7, including a second slide, a second drive motor connected to said second slide and moving said slide and a second pitman arm connected between said holder and said second slide.

* * * * *